US006145600A

United States Patent [19]

Dickinson

[11] Patent Number: 6,145,600

[45] Date of Patent: Nov. 14, 2000

[54] PORTABLE APPARATUS FOR SOIL SAMPLING

[76] Inventor: Larry Dickinson, 42125 S. Morton Rd., Kennewick, Wash. 99337

[21] Appl. No.: 09/349,193

[22] Filed: Jul. 7, 1999

[51] Int. Cl.[7] ..... E21B 49/02

[52] U.S. Cl. ..... 175/20; 73/864.43; 175/209

[58] Field of Search ..... 175/20, 58, 209, 175/210, 323; 73/864.43

[56] References Cited

U.S. PATENT DOCUMENTS

| | | | |
|---|---|---|---|
| 1,927,871 | 9/1933 | Irwin et al. | 175/323 |
| 3,406,765 | 10/1968 | Alexander | 175/323 |
| 3,440,886 | 4/1969 | Meeker | 175/323 |
| 3,447,381 | 6/1969 | Langtry et al. | 73/864.43 |
| 3,492,875 | 2/1970 | Tonjes | 73/864.43 |
| 3,593,809 | 7/1971 | Derry | 175/51 |
| 3,760,893 | 9/1973 | Meeker | 175/316 |
| 4,317,494 | 3/1982 | Hightower | 175/209 |
| 4,482,021 | 11/1984 | Repski | 175/209 |
| 4,534,231 | 8/1985 | Jonsson et al. | 73/864.43 |
| 4,653,336 | 3/1987 | Vollweiler | 73/864 |
| 5,394,949 | 3/1995 | Wright | 175/20 |
| 5,673,762 | 10/1997 | Pennengton | 175/20 |
| 5,950,741 | 9/1999 | Wright et al. | 175/20 |

FOREIGN PATENT DOCUMENTS

| | | | |
|---|---|---|---|
| 976172 | 11/1964 | United Kingdom | 73/864.43 |

*Primary Examiner*—David Bagnell
*Assistant Examiner*—Joselynn Sliteris
*Attorney, Agent, or Firm*—Liebler, Ivey & Connor; Steven J. Staihar

[57] ABSTRACT

A soil sampling apparatus comprising a cylindrical body having an upper end, a lower end, and an egress aperture located along the cylindrical body proximal the lower end. The apparatus further includes a handle connected to the upper end of the cylindrical body for manual positioning and securing the apparatus while in use. The apparatus further includes a base plate with an aperture therein for receiving the cylindrical body at the lower end. The cylindrical body is secured to the base plate and extends a distance through the aperture of the base plate, thereby defining a probe. A shaft may be connected to an auger and positioned within the cylindrical body for upward and downward movement therein. A drill may be used for rotating the shaft and auger. The apparatus further includes a receptacle comprising an ingress aperture. The receptacle may be joined to the cylindrical body, the ingress aperture juxtaposed the egress aperture.

8 Claims, 6 Drawing Sheets

PORTABLE APPARATUS FOR SOIL SAMPLING

FIELD OF THE INVENTION

The present invention relates generally to an apparatus for soil sampling and more particularly to a light-weight, portable soil sampling apparatus for rapidly and efficiently collecting a soil sample for analysis.

BACKGROUND OF THE INVENTION

Obtaining a sample of soil for testing often requires insertion of a sampler device into the soil and removal of a soil sample. It is often desired to obtain a sample 9 inches below the surface but it may be desired to obtain a sample further below the surface, e.g., 3 feet below.

Labor and time are critical factors in the selection of a soil sampling device. Use of an auger eliminates the need to grind or break up the soil for further testing. Moreover, while certain soil sampling devices are made for use in conjunction with a vehicle, this is often not feasible under certain conditions such as wet soil.

Devices and methods directed to soil sampling include U.S. Pat. No. 3,593,809 to Derry; U.S. Pat. No. 5,673,762 to Pennington; U.S. Pat. No. 5,394,949 to Wright et al.; U.S. Pat. No. 4,482,021 to Repski; U.S. Pat. No. 4,653,336 to Vollweiler; U.S. Pat. No. 3,760,893 to Meeker.

The foregoing patents and printed publications are provided herewith in an Information Disclosure Statement in accordance with 37 CFR 1.97.

SUMMARY OF THE INVENTION

The present invention provides an apparatus and method for efficiently obtaining ample quantities of soil without the need for repeated manipulation and transfer of the sample. The invention additionally provides an apparatus and method for increasing the speed of the soil sampling process and provides an apparatus and method which is inexpensive and easy to use in all types of soil.

The present invention discloses a soil sampling apparatus, said apparatus comprising a cylindrical body comprising an upper end, a lower end, an egress aperture located along said cylindrical body proximal the lower end; a handle connected to the upper end of said cylindrical body for manual positioning and securing the apparatus while in use; a base plate with an aperture therein receiving said cylindrical body at the lower end, said cylindrical body secured to said base plate and extending a distance through the aperture of said base plate thereby defining a probe; a shaft joined to an auger and positioned within said cylindrical body for upward and downward movement therein; power means for rotating said shaft and auger; a receptacle having an ingress aperture to receive soil; said receptacle joined to said cylindrical body, the ingress aperture juxtaposed the egress aperture.

In the preferred embodiment, the bottom of said egress aperture is located about 2.125 inches above the top of said base plate; the bottom of the receptacle ingress aperture is located about 2.125 inches above the bottom of said receptacle. The top of said egress aperture is located about 7.25 inches above the top of said base plate; the height of said ingress aperture is about 7.25 inches. These dimensions are preferred to attain quick collection of a large soil sample without the need for frequent removal of soil from the receptacle. The apparatus is preferably composed of stainless steel. The receptacle may be joined to the cylindrical body by a hook and slot mechanism, said slot fixed to the cylindrical body and said hook located on said receptacle. A lip may be formed on said base plate to secure the receptacle in place. Those of ordinary skill in the art will recognize that other configurations for joining the receptacle to the cylindrical body may work as well. The receptacle may further comprise a discharge aperture on the top of the receptacle for removal of a soil sample from said receptacle. The auger is preferably a double or multiple-flighted auger to facilitate quick removal of the soil sample. The power means may be a drill. The handle may further comprise a power means rest to hold a drill or any other power means as recognized by one of ordinary skill in the art.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
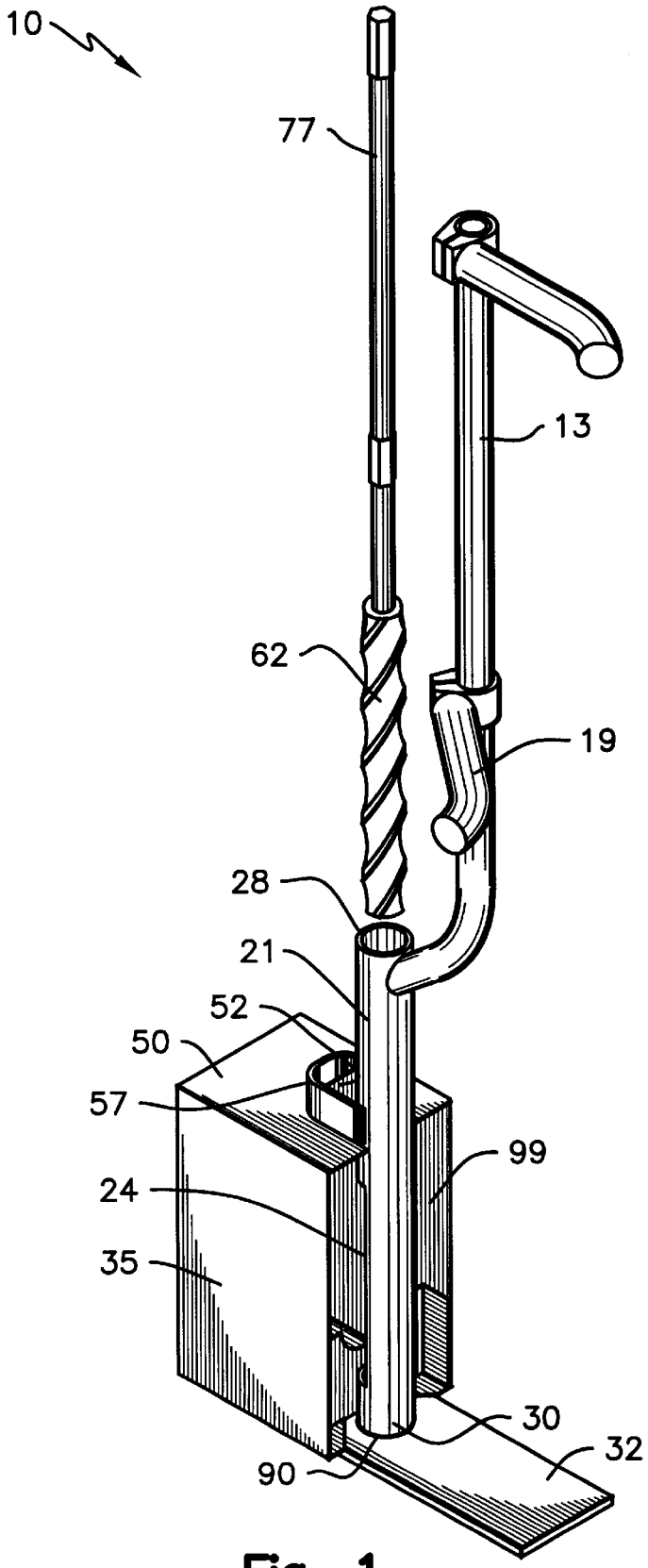
FIG. 1 is a perspective view of the apparatus showing the cylindrical body with ingress aperture and handle, base plate, auger and shaft, and receptacle with ingress aperture joined to the cylindrical body by a hook and slot mechanism. Also shown is the discharge aperture on the top of the receptacle.
Figure 2:
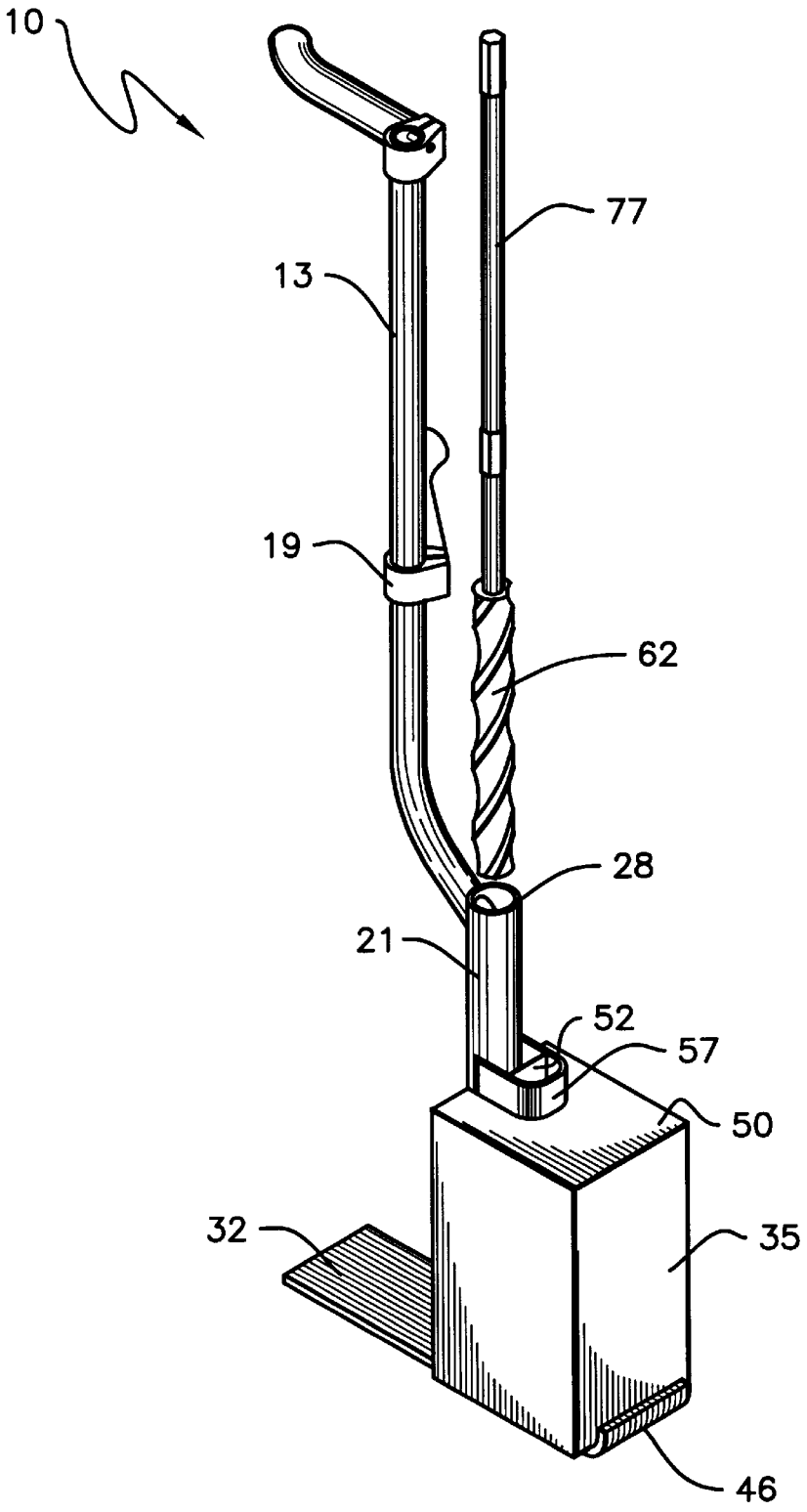
FIG. 2 is a perspective view of the apparatus showing the cylindrical body with handle, base plate, auger and shaft, and receptacle joined to the cylindrical body by a hook and slot mechanism. Further shown is a lip on the base plate to secure the receptacle in place.
Figure 3:
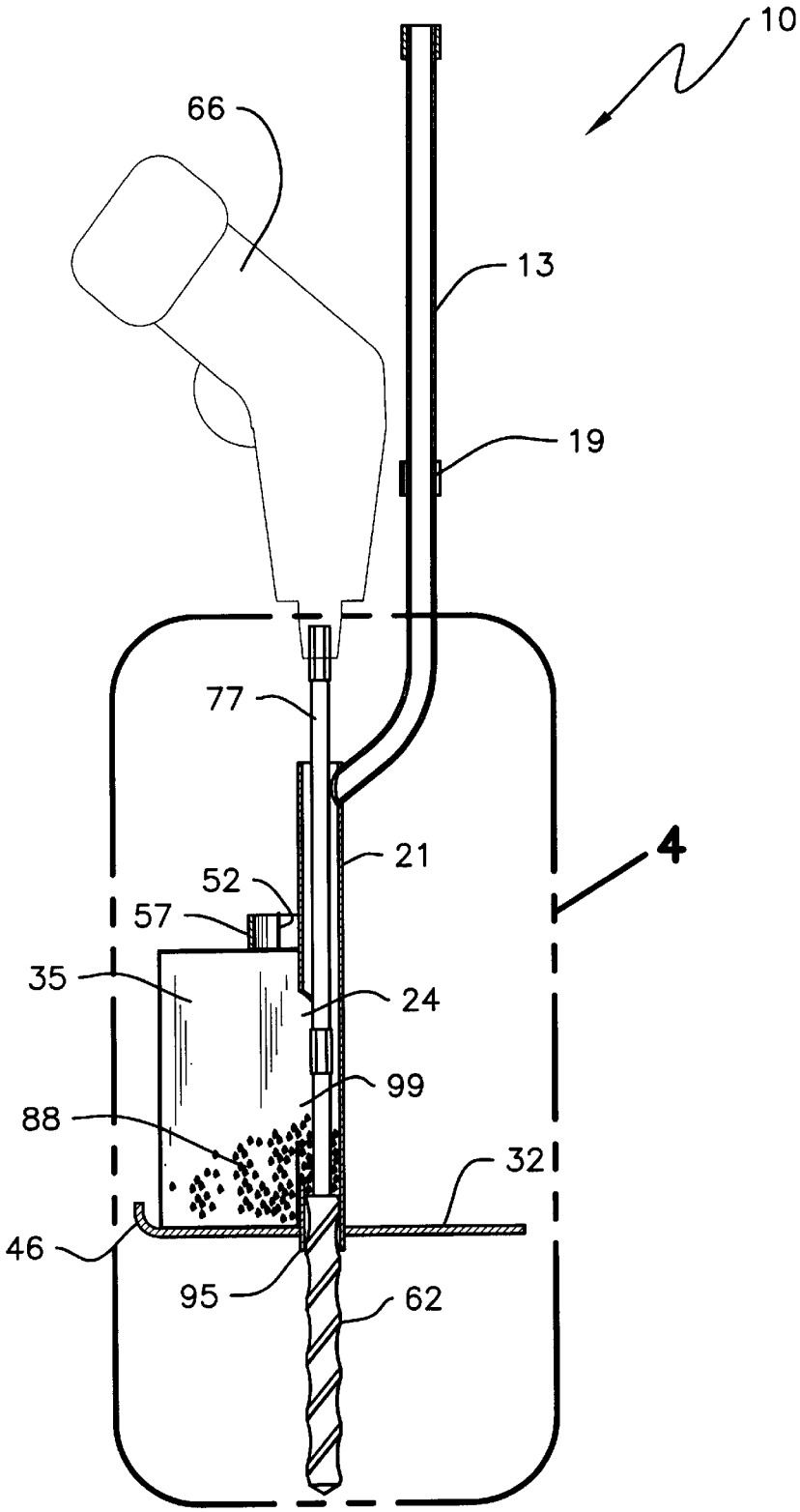
FIG. 3 is a side section view of the apparatus showing the cylindrical body with egress aperture and handle, base plate with lip, auger and shaft, drill connected to the shaft, and receptacle with ingress aperture to receive soil and joined to the cylindrical body by a hook and slot mechanism.
Figure 4:
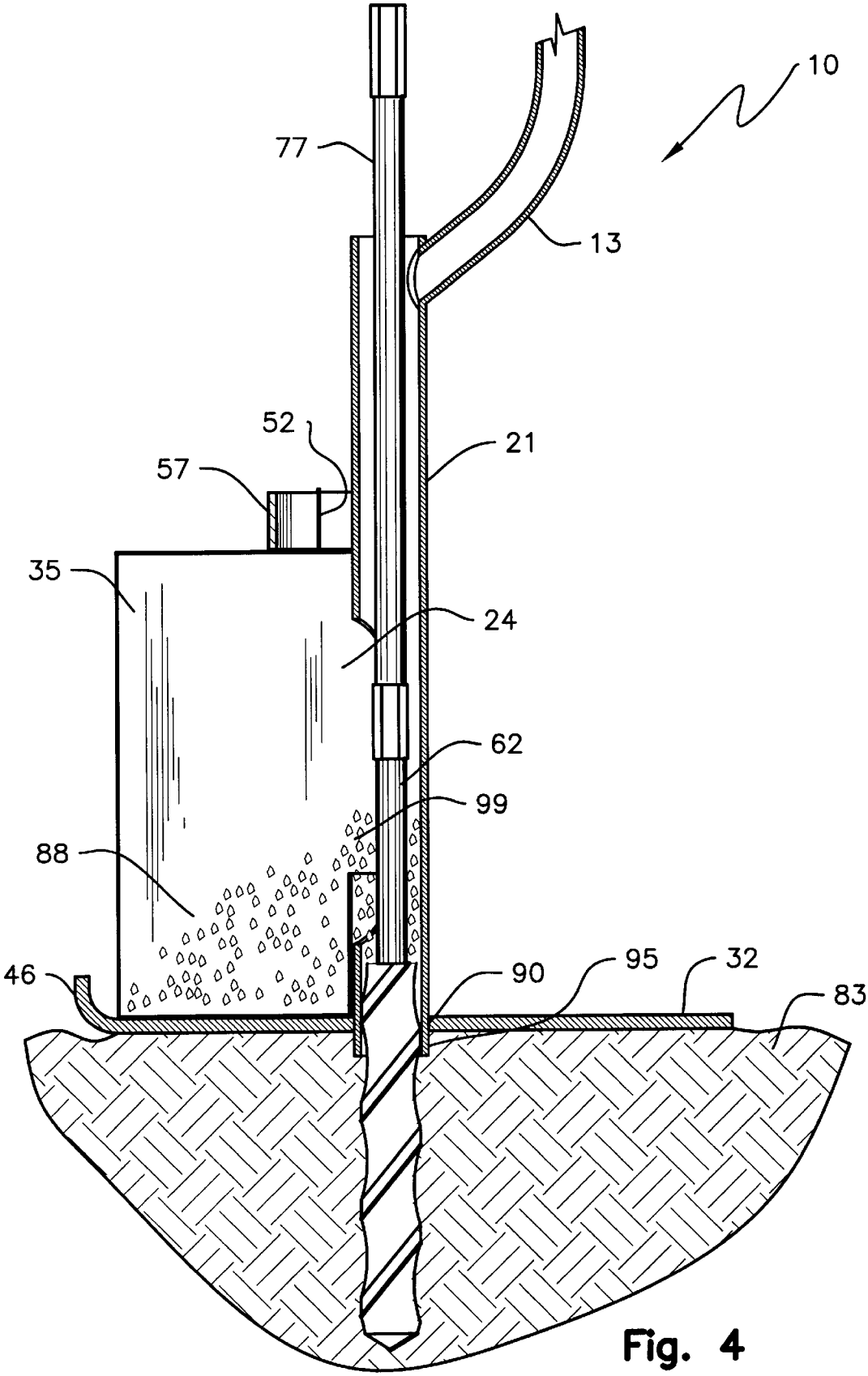
FIG. 4 is a side section view of the apparatus showing the cylindrical body with egress aperture and handle, base plate with lip, auger and shaft, drill connected to the shaft, and receptacle with ingress aperture to receive soil and joined to the cylindrical body by a hook and slot mechanism. Further shown is the auger within the ground to extract a soil sample.
Figure 5:
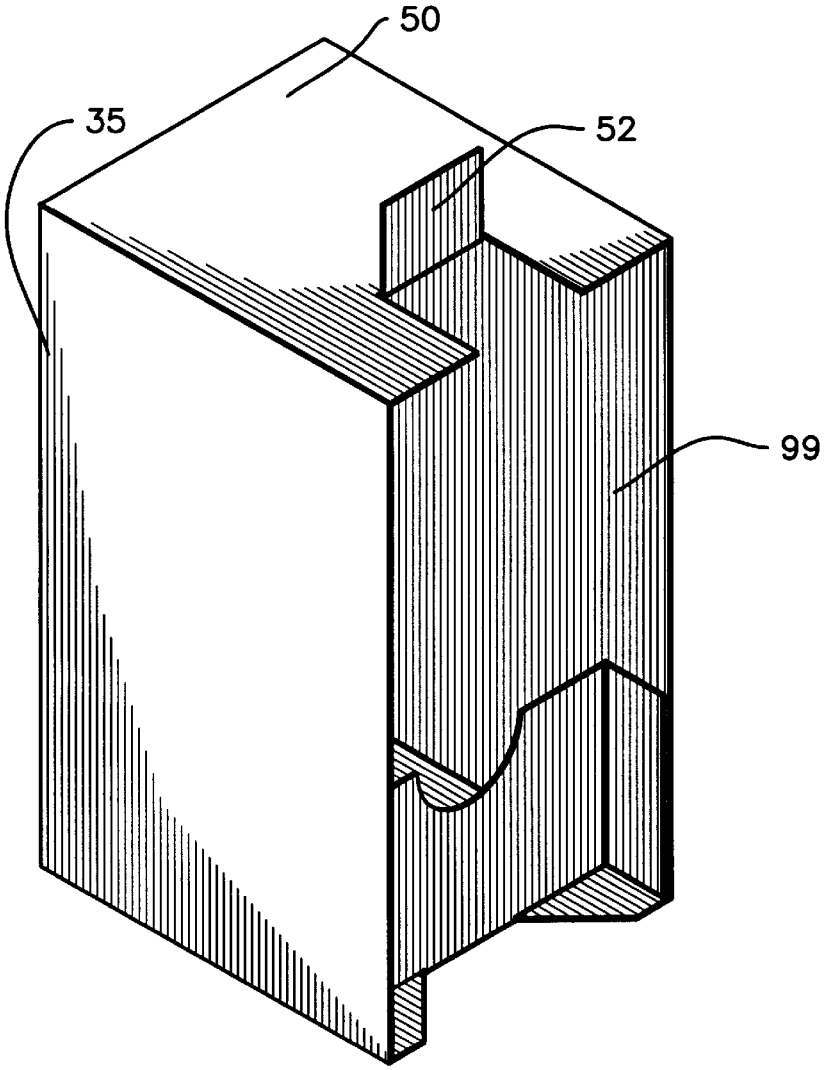
FIG. 5 is a perspective view of the receptacle showing the ingress aperture, discharge aperture, and a hook on the receptacle top to be received by a slot on the cylindrical body.
Figure 6:
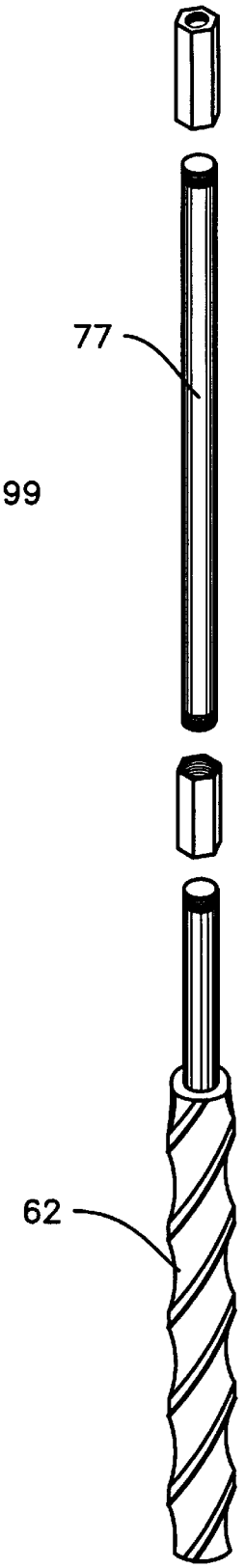
FIG. 6 is a side view showing the auger, shaft, and couplings to join the auger and shaft together and to further join the shaft to power means.
Figure 7:
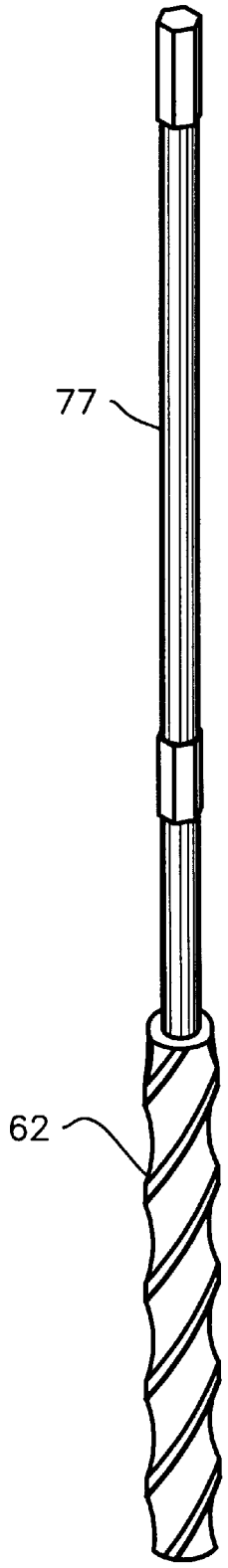
FIG. 7 is a side view showing the auger and shaft joined together.

The soil sampling apparatus is illustrated herein in FIG. 1 through FIG. 7. The apparatus 10 comprises a cylindrical body 21 comprising an upper end 28, a lower end 30, an egress aperture 24 located along said cylindrical body 21 proximal the lower end 30; a handle 13 connected to the upper end 28 of said cylindrical body 21 for manual positioning and securing the apparatus 10 while in use; a base plate 32 with an aperture 90 therein receiving said cylindrical body 21 at the lower end 30; said cylindrical body 21 secured to said base plate 32 and extending a distance through the aperture 90 of said base plate 32, thereby defining a probe 95; a shaft 77 connected to an auger 62, by e.g., threaded couplings, and positioned within said cylindrical body 21 for upward and downward movement therein; power means 66 for rotating said shaft 77 and auger 62; a receptacle 35 having a top and a bottom joined together by a plurality of sides, an ingress aperture 99 to receive a soil sample; said receptacle 35 joined to said cylindrical body 21, the ingress aperture 99 juxtaposed the egress aperture 24. Said cylindrical body 21 may be secured to the base plate 32 by a weld, screws, friction, or any other securing means as recognized by those of ordinary skill in the art. In an alternative embodiment, the cylindrical body 21 may be formed integral with said base plate 32.

In the preferred embodiment, the bottom of said egress aperture 24 is located about 2.125 inches above the top of said base plate 32; the bottom of the receptacle ingress aperture 99 is located about 2.125 inches above the bottom of said receptacle 35. The top of said egress aperture 24 is located about 7.25 inches above the top of said base plate 32; the height of said ingress aperture 99 is about 7.25 inches. These dimensions are preferred to attain quick collection of a large soil sample 88 without the need for frequent removal of soil 88 from the receptacle 35. The apparatus 10 is preferably composed of stainless steel. The receptacle 35 may joined to the cylindrical body 21 by a hook and slot mechanism, said slot 57 located on the cylindrical body 21 and said hook 52 located on said receptacle 35 whereby the slot 57 receives the hook 52. A lip 46 may be formed on an end of said base plate 32 to facilitate holding the receptacle 35 in place. Those of ordinary skill in the art will recognize that other configurations for joining the receptacle 35 to the cylindrical body 21 may work as well. The receptacle 35 may further comprise a discharge aperture 50 on the top of the receptacle 35 for removal of a soil sample 88 from said receptacle 35. The auger 62 is preferably a double or multiple-flighted auger to facilitate quick removal of the soil sample 88. The power means 66 may be a drill. The handle may further comprise a power means rest 19 to hold a drill or any other power means as recognized by one of ordinary skill in the art.

To obtain a sample of soil 88, the apparatus 10 may be placed onto a soil surface 83; the probe 95 may be inserted into said surface 83. While the power means 66, e.g., a drill, rotates the shaft 77 secured to the auger 62, by e.g., a coupling, the user inserts the auger 62 into the soil surface 83 and then removes said auger 62. The soil 88 flows from the auger 62, through the egress aperture 24, and into the receptacle 35 via the ingress aperture 99. The position of the egress aperture 24 and ingress aperture 99 in the preferred embodiment facilitates the quick collection of a large soil sample 88 without the need for frequent removal of the soil 88 from the receptacle 35.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A soil sampling apparatus comprising:

a cylindrical body comprising an upper end, a lower end, an egress aperture with a top and a bottom and located along said cylindrical body proximal said lower end;

a handle connected to the upper end of said cylindrical body for manual positioning and securing the apparatus while in use;

a base plate with a top, a bottom, and an aperture therein receiving said cylindrical body at the lower end, said cylindrical body secured to said base plate and extending a distance through the base plate aperture thereby defining a probe;

an auger positioned within said cylindrical body for upward and downward movement therein;

power means for rotating said auger;

a receptacle having an ingress aperture therein, with a top and a bottom, to receive a soil sample; said receptacle joined to said cylindrical body, the ingress aperture juxtaposed the egress aperture.

2. The apparatus of claim 1 wherein the bottom of said egress aperture is located about 2.125 inches above the top of said base plate; the bottom of the receptacle ingress aperture is located about 2.125 inches above the bottom of said receptacle.

3. The apparatus of claim 2 wherein the top of said egress aperture is located about 7.25 inches above the top of said base plate; the height of said ingress aperture is about 7.25 inches.

4. The apparatus of claim 1 wherein said apparatus is composed of stainless steel.

5. The apparatus of claim 1 wherein said receptacle is joined to the cylindrical body by a hook and slot mechanism, said slot located on the cylindrical body and said hook located on said receptacle, whereby the slot receives the hook.

6. The apparatus of claim 5 further comprising a lip formed on an end of said base plate thereby facilitating the support of the receptacle in place.

7. The apparatus of claim 1 further comprising a discharge aperture on the top of the receptacle for removal of a soil sample therefrom.

8. The apparatus of claim 1 further comprising a power means holder located on said handle to hold a power means.

* * * * *